US005163467A

United States Patent [19]

Coe

[11] Patent Number: 5,163,467

[45] Date of Patent: Nov. 17, 1992

[54] RECYCLING AND LEAK DETECTION SYSTEM FOR LIQUID STORAGE AND DELIVERY APPARATUS AND METHOD OF REPAIR

[75] Inventor: Gary D. Coe, Bedford, Va.

[73] Assignee: Control On Environment Systems, Inc., Bedford, Va.

[21] Appl. No.: 801,579

[22] Filed: Dec. 5, 1991

[51] Int. Cl.[5] ..... F17D 5/02; B67D 1/16

[52] U.S. Cl. ..... 137/312; 222/109; 137/15

[58] Field of Search ..... 137/312, 313, 314, 596, 137/596.1, 15; 222/108, 109, 110, 111

[56] References Cited

U.S. PATENT DOCUMENTS

| | | | |
|---|---|---|---|
| 3,172,567 | 3/1965 | Deters | 222/110 X |
| 4,638,920 | 1/1987 | Goodhues, Jr. . | |
| 4,696,330 | 9/1987 | Raudman et al. . | |
| 4,842,443 | 6/1989 | Argandona | 137/312 X |
| 4,926,899 | 5/1990 | Argandona | 137/312 X |
| 4,971,225 | 11/1990 | Bravo | 222/110 |
| 4,989,634 | 2/1991 | Rieseck . | |
| 5,052,217 | 10/1991 | Sharp . | |
| 5,060,509 | 10/1991 | Webb | 137/312 X |

*Primary Examiner*—Martin P. Schwadron
*Assistant Examiner*—Kevin L. Lee
*Attorney, Agent, or Firm*—Richard C. Litman

[57] ABSTRACT

This invention relates to a facility for storage of liquids, and more specifically, a leak detection system for an automotive service station. This system consists of a plurality of tanks provided with pipelines. This tank system is stored in a multi-walled vault or containment box. The pump lines are surrounded or contained with return spill casings. If a leak occurs in the lines, the gasoline flows by gravity to a separate service chamber. In this rectangular service chamber, the leak can be visibly observed from a top view by a service station attendant and should a pipeline require replacement, it is readily withdrawn from its casing and replaced, without any excavation.

6 Claims, 4 Drawing Sheets

RECYCLING AND LEAK DETECTION SYSTEM FOR LIQUID STORAGE AND DELIVERY APPARATUS AND METHOD OF REPAIR

FIELD OF THE INVENTION

This invention relates generally to liquid handling and more particularly, to an improved apparatus and method for the storage and/or delivery and recycling of liquids, especially those liquids having at least the potential for causing pollution, contamination or otherwise affecting the environment. More specifically, the present invention relates to an above ground or below ground facility for fuel storage tanks, more particularly to a gas leak detection system for the tanks, and more specifically for the pipelines connected therefrom.

BACKGROUND OF THE INVENTION

It will be appreciated that ever-increasing restrictions are being placed upon apparatus and methods employed for the storing and delivering of various classes of liquids. For years, many quite common products have been classified as hazardous materials (HAZMAT) and as such, are subject to numerous restrictions during the conveyance, loading, storage, use, etc. thereof. Many HAZMAT products face even tighter restrictions during the very near future and in some instances, governmental requirements due to go into effect soon, will make obsolete a significant number of existing liquid handling installations. One such liquid category particularly addressed by the present invention comprises hydrocarbon fuels. Many situations exist wherein underground fuel storage tanks and/or the lines communicating between the tanks and dispensing pumps, have ruptured or otherwise developed a leak and seriously contaminated the soil and associated water tables. Notwithstanding any long term damage which may occur to the soil in the area of damaged equipment, the very repair maneuvers can often be prohibitive. And now, with the forthcoming national requirement that all underground fuel storage tanks will have to be unearthed, raised and suitably treated every eight years, whether or not leakage has been detected, many present businesses will be forced to close. This will be true since, even the smallest gasoline service station will face the expense of several thousand dollars per tank to carry out such a periodic procedure. Also, if any leakage is detected, either during such periodic servicing or at any other time, the same tank removal expense would be encountered in addition to the costly and time consuming operation of excavating throughout the extent of all buried pipelines in order to locate and replace faulty conduits. It is highly desirable to provide an arrangement wherein not only may fuel leakages be readily and quickly identified but also, the repair thereof may be accomplished with a minimum of effort and with negligible down-time whether the system comprises an above ground or buried installation.

DESCRIPTION OF THE RELATED ART

In the prior art, storage tanks are frequently used for the storage of various liquids, such as gasoline, fuel oil, diesel oil, toxic fluids or various chemicals. These storage tanks are stocked and then supply the liquid through a series of pipelines communicating with delivery devices such as pumps located within automobile service stations, in the case of automotive fuels. In other situations, the storage and delivery system may be associated with any of various types of chemical manufacturing installations.

In the event that a crack or a fault develops in the pipeline or tank, the gasoline will leak into the ground. Not only is this wasteful, but more importantly, it pollutes the environment. Many existing fuel supply systems for automobile service stations are fairly old, for example twenty-five years old, and the leakage may occur over a relatively long period of time prior to detection. The tank and the entire piping system must be dug up and removed, either repaired or replaced and clean-up operations commenced in the surrounding environment. In gasoline stations, especially, it is difficult to detect, particularly early on, if a pipeline has developed a leak, and furthermore, pinpointing the exact locus of the leak often can prove quite challenging. The problem may become especially pronounced in suburban or rural areas where the surrounding homeowners depend upon underground wells for available supply of fresh water. In the event of leakage of any liquid contaminant, these fresh water supplies may become spoiled and unusable.

Examples of efforts to detect spillage in liquid handling systems will be found in U.S. Pat. Nos. 4,638,920 issued to Goodhues, Jr. on Jan. 27, 1987, 4,696,330 issued to Raudman et al. on Sep. 29, 1987, 4,989,634 issued to Rieseck on Feb. 5, 1991 and 5,052,217 issued to Sharp on Oct. 1, 1991, respectively. In Goodhues, Jr., there is disclosed an underground storage fuel system usable for containing fuel for automobile gasoline stations and which is equipped with a leak detection rod (32). This rod aids in determining whether a leak has occurred in the bottom of the tank (See FIG. 5).

The above mentioned Raudman et al. patent teaches the use of a receptacle or tank as used for accommodating spillage of hazardous liquids.

The Rieseck patent is noted for its disclosure of a liquid containment box for a liquid delivery system but which serves merely those pipeline portions disposed immediately beneath the customer usable dispensing pump.

In the Sharp patent there is illustrated a further leak containment arrangement in a tank system for the storage of liquid gas and which includes a leak drip sump compartment.

None of the above identified prior patents is seen to suggest the unique system as taught herein.

SUMMARY OF THE INVENTION

It is the object of the present invention to alleviate the disadvantages of the prior art by providing a leak detection system consisting of an improved liquid storage and delivery apparatus wherein pipelines or conduits communicating between one or more storage tanks and any number of dispensing stations, are constructed and disposed in a manner facilitating the early detection of a leak in any of the pipelines and the storage tank. Should such a leak occur, it is collected within a larger diameter conduit or casing enshrouding the respective pipelines and with these casings designed in a manner so that the fluid will drain by least resistance into a service chamber located intermediate the dispensing stations and storage tanks. All fluid pipelines communicating with the dispensing stations and storage tanks are similarly enshrouded and pass through the service chamber with an end of each casing terminating within the service chamber so that leakage developing in any pipeline is quickly detected as it drains into the basin of the service chamber. One or more return lines lead from this basin to one of the storage tanks so that fluid as directed into the service chamber basin is automatically redirected to the tank.

Access to the fill pipes for the tanks is located within the same service chamber so that during each delivery of fuel or other liquid, an operator will instantly detect the existence of leakage in the system and also, any spillage that occurs during the delivery process will be carried away through the same return line to one of the tanks.

Upon the detection of leakage, repair of the faulty pipeline is accomplished in a vastly improved manner with but minimal or without any pavement cutting or excavation, in the case of installations wherein the tanks and pipelines are disposed underground. The guilty pipeline is instantly identified by viewing the casing from which the leaking fluid is dripping into the service basin. Through an access door, the pipeline is disconnected at either the dispensing station or storage tank as applicable, and the opposite end is disconnected at a coupling disposed within the service chamber. Thereafter, the disconnected pipeline containing the fault is extracted from within its casing by pulling it out from the top of the service chamber and a similar length of replacement pipeline is re-inserted into the pertinent casing and the two ends thereof connected to restore the system with minimum disruption. The delivery apparatus is then ready to resume operation with but a minimum down-time. This effective leak detection system alleviates the need to shut down an entire liquid supply system. This system is cost effective because it provides a quick and easy removal of the defective pipeline, thereby making the replacement cost of pipes lower for the owner.

Accordingly, an object of the present invention is to provide an improved liquid tank and pipeline system including a plurality of pipelines communicating between one or more delivery stations and at least one storage tank and wherein the pipelines are disposed within larger diameter pipes or casings, the latter of which are inclined downwardly toward an intermediate service chamber providing a central point at which leakage from any of the pipelines will be detected.

Another object of the present invention is to provide an improved liquid tank and pipeline system including a plurality of pipelines communicating between delivery and storage means and passing through or accessible within an intermediate service chamber, with each pipeline disconnectable adjacent a respective delivery or storage device and axially removable and replaceable through the service chamber.

A further object of the present invention is to provide an improved liquid tank and pipeline system containing a service chamber receiving leakage from all pipelines in the system and having a conduit automatically directing such received leakage, by gravity, to one of the tanks as located laterally of the service chamber.

A further object of the present invention is to provide an improved method of repairing a liquid tank and pipeline system wherein all pipelines are disposed within a casing and any one faulty pipeline is uncoupled at its ends and withdrawn from its casing and replaced by a serviceable pipeline.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

FIG. 3 is an enlarged cross-sectional view of one of the pipelines and its surrounding casing;

FIG. 4 is an exploded top perspective view of the vault containment system for the tanks, illustrating the removable covers containing individual access ports;

Similar reference characters designate corresponding parts throughout the several figures of the drawings.

DESCRIPTION OF THE PREFERRED EMBODIMENT

Figures 2, 2A:
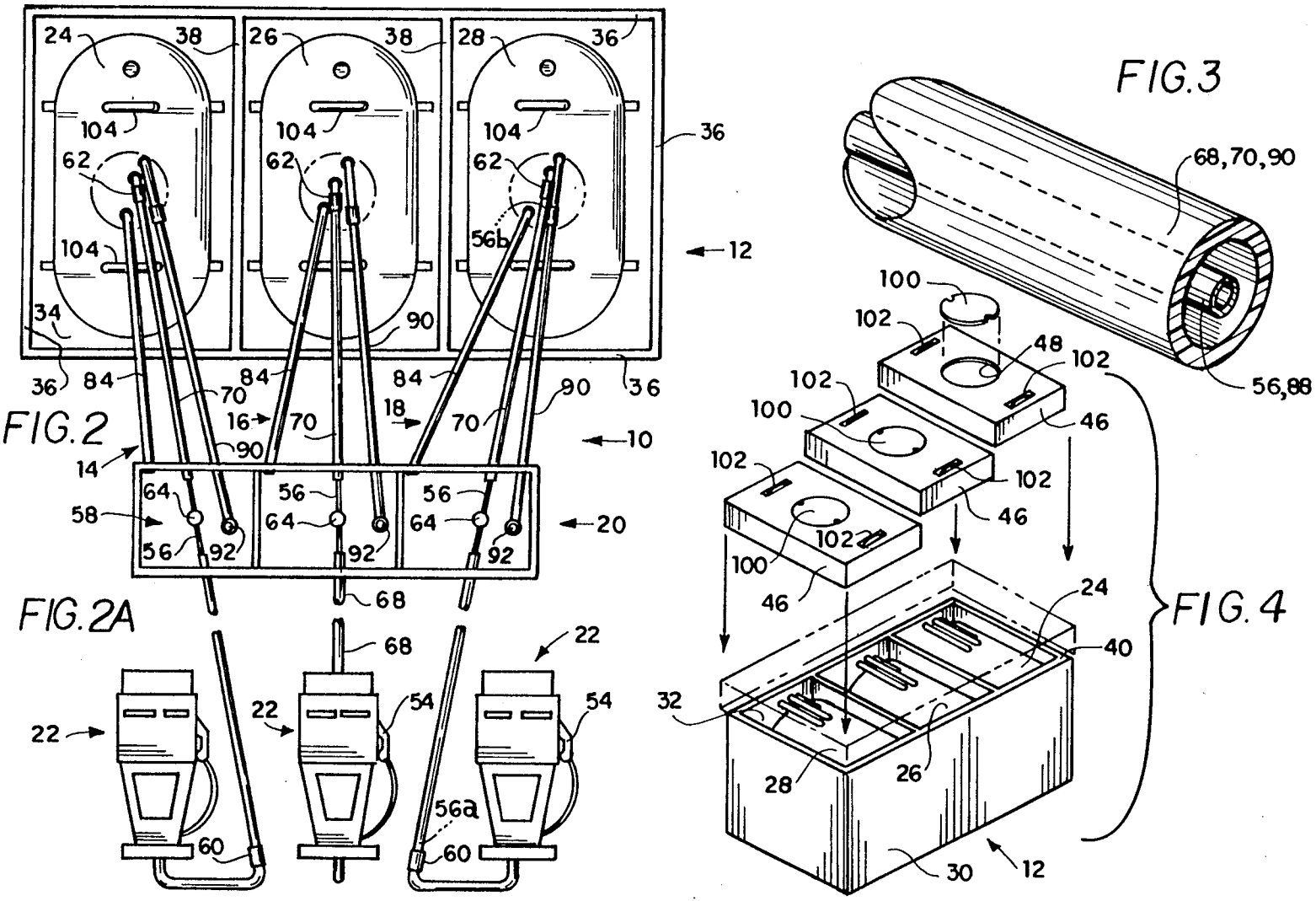
FIG. 2 is a top plan view of storage tanks and the plurality of pipelines as communicating the service chamber of the system.
FIG. 2A is a front elevation of representative dispensing stations usable with the present system.

Referring now to the drawings, particularly FIGS. 2–2A, the present invention will be seen to relate to a liquid storage and delivery system, generally designated 10, and which includes a tank storage or containment assembly 12 and a plurality of conduit assemblies 14, 16 and 18 communicating with a service chamber 20 and/or a plurality of delivery stations 22. As most clearly shown in FIGS. 5–6 of the drawings, the system 10 is directed to a fuel storage and delivery system as used for an automobile service station and wherein the storage assembly 12 and various conduit assemblies 14–18 are disposed underground. However, it will be appreciated that the leak detection system and pipeline repair method as described herein may very well carry over to any of various liquid storage and delivery systems as included in an above ground installation.

The tank containment assembly 12 comprises an enclosure adapted to fully surround the lateral and bottom extent of one or more liquid storage tanks 24, 26, 28 of any suitable well known configuration and may be adapted to be at least partially disposed below grade. The tanks are of any desired capacity, such within the range of 550–50,000 gallons. This enclosure will be seen to include an outermost envelope 30 of liquid impervious composition, such as any of several well known synthetic resinous products and serves as a barrier to discourage liquid migration of fluids reaching its interior, into the surrounding soil or environment. Lowered into the envelope 30 is a rigid vault 32 having a bottom wall 34 joined to peripheral walls 36 and which preferably includes partition walls 38 dividing the otherwise open top 40 of the vault into adjacent, isolated cavities 42, each serving to fully accommodate an individual one of the liquid storage tanks 24, 26 or 28. The various walls and bottom of the vault 32 are constructed of suitable castable material such as concrete and the formed cavities are of dimensions capable of accomodating the respective tanks therein while providing for at least a minimal clearance thereabout. When the tanks are installed within the cavities 42, the remaining space is back-filled with stabilizing aggregate material such as peastone and/or sand 44.

Figure 5:
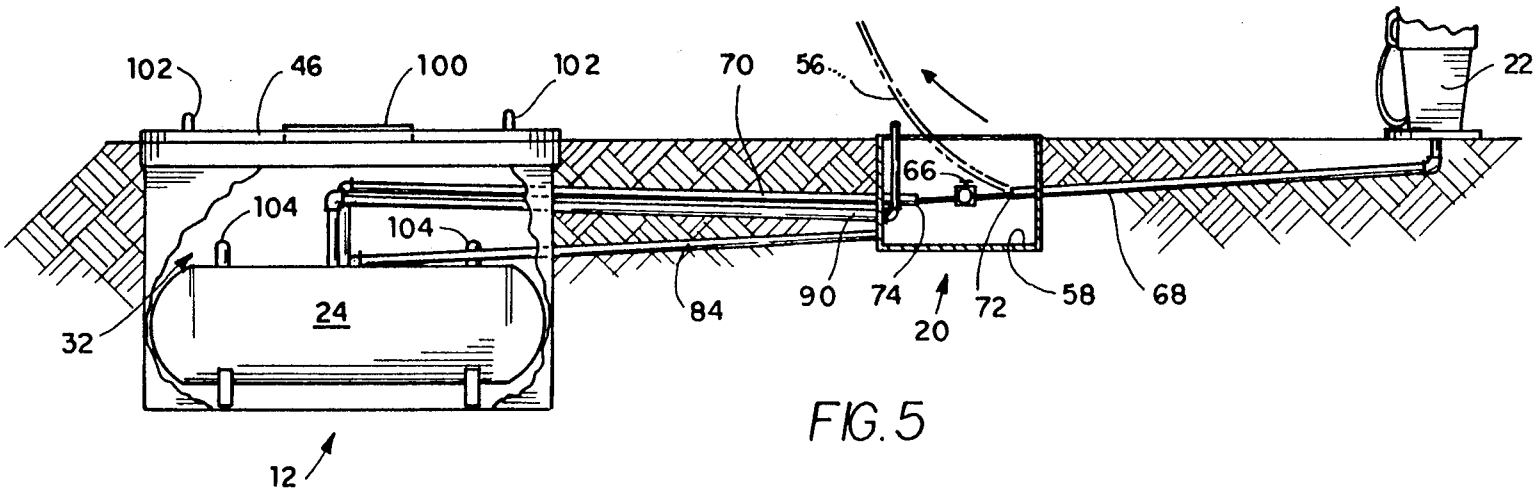
FIG. 5 is a side elevation, partly in section, of the storage delivery system as shown in FIGS. 2 and 2A.
Figure 6:
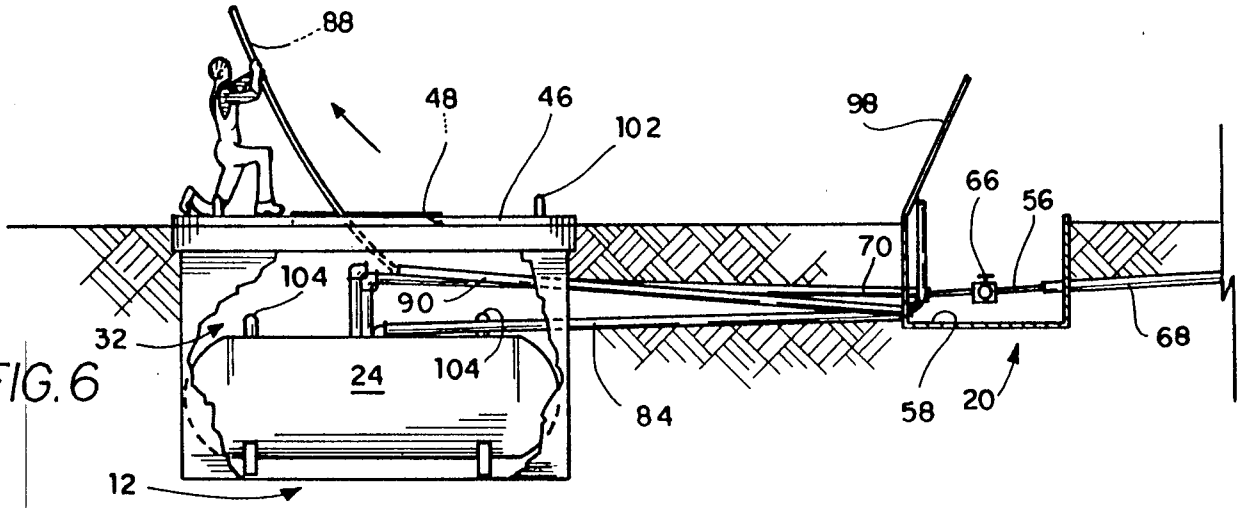
FIG. 6 is a side view illustrating the method of removal of a defective pipeline from within its casing and through the tank vault.

As shown in FIGS. 4–6, the open top 40 of the vault is adapted to be enclosed by one or more covers 46 constructed of any well known lightweight, stable composition. Individual covers 46 may be provided for each tank cavity 42 of the vault 32 and each cover includes an access manhole 48 located atop that area of the contained tank wherein a plurality of fittings are positioned.

Each tank cavity or compartment 42 is provided with a vertical stand pipe 50 extending from above the open top area 40 to the bottom wall 34 and which form a vent and include a test rod 52 comprising a well known vapor detector device adapted to signal the presence of any of the subject liquid that has leaked into the cavities 42.

The aforedescribed tank containment assembly 12 provides for the storage of a desired liquid, such as motor fuel, and which is intended to be dispensed by one or more of the delivery stations 22 of FIGS. 2A and 5. These latter stations will be understood to include conventional pump means adapted to withdraw liquid from a respective storage tank and direct it through an appropriate discharge member 54.

Figure 1:
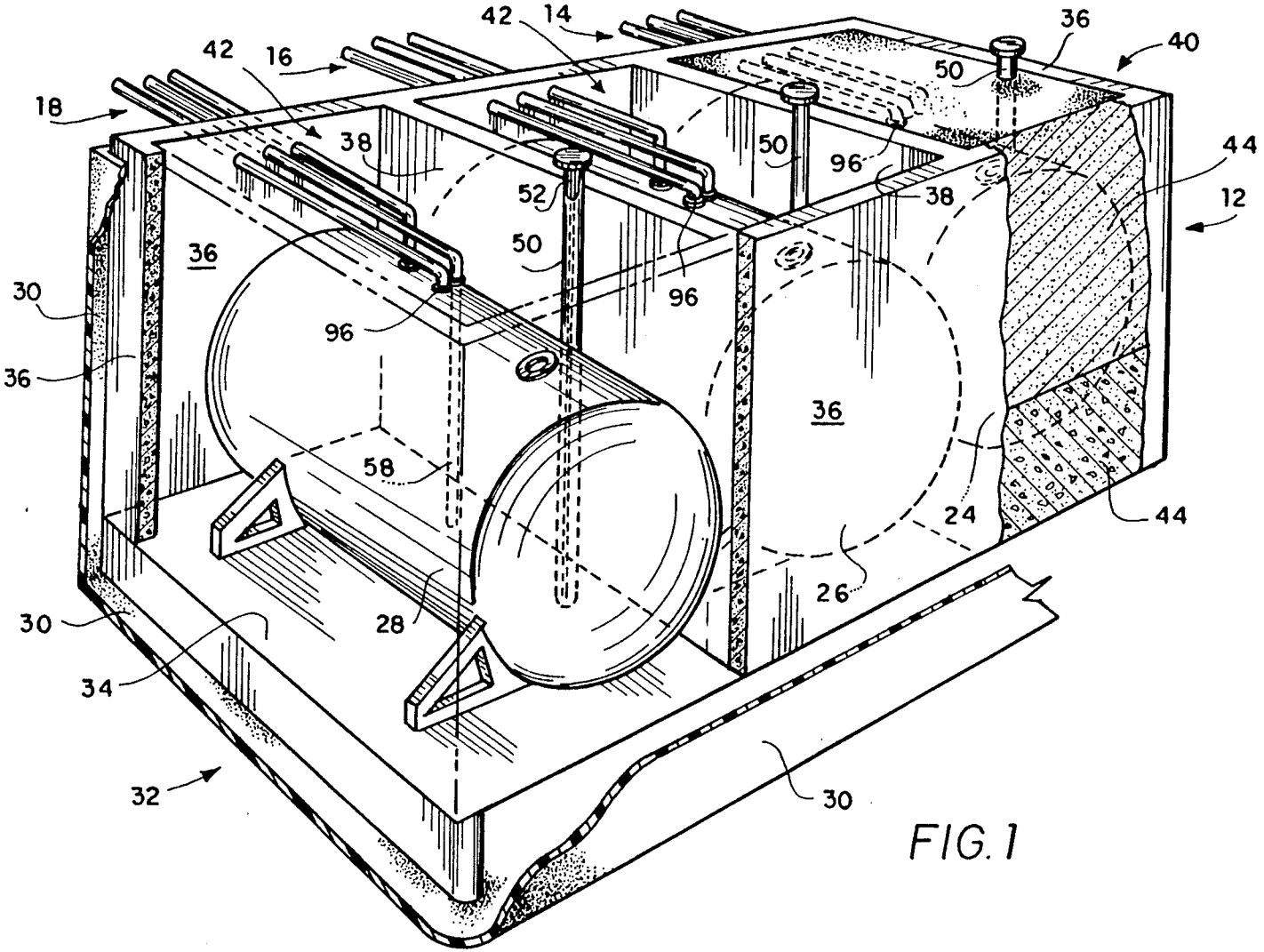
FIG. 1 is a top perspective view of a typical storage tank assembly as used with the present invention.

Liquid from each storage tank is transmitted through an individual supply conduit assembly 16 which includes an innermost delivery pipeline 56 having opposite ends respectively communicating with one of the tanks 24, 26, 28 and one delivery station 22. One said pipeline end will be seen from FIG. 1 to comprise an inlet end 58 extending into the lower reaches of a tank so that as the attached delivery station 22 is operated, fuel will be drawn from the tank and directed through the discharge member 54.

The detection, handling and repair of a leakage occurring at any point within the delivery pipeline 56 is accommodated by the inclusion of the service chamber 20 intermediate the opposite ends of the supply conduit assemblies 16. To provide a single, centralized point at which a leakage may be detected in any one of the plurality of supply conduit assemblies 16, all of these latter assemblies will be understood to have their delivery pipelines 56 pass through the confines of the basin or spill chamber 58. This chamber is constructed of a suitable liquid impervious composition such as fiber-reinforced-plastics. Although each pipeline 56 normally provides for continuous communication between its two opposite ends **56*a* and 56*b*, these ends preferably are provided with a union 60 and 62 respectively, for reasons which will be obvious hereinafter. Additionally, that portion of the delivery pipeline 56 disposed within the service chamber basin 58, is likewise provided with a union 64. Each of these unions may alternatively be supplied with a suitable shut-off valve 66 such as shown in FIGS. 5–6**.

Figure 7:
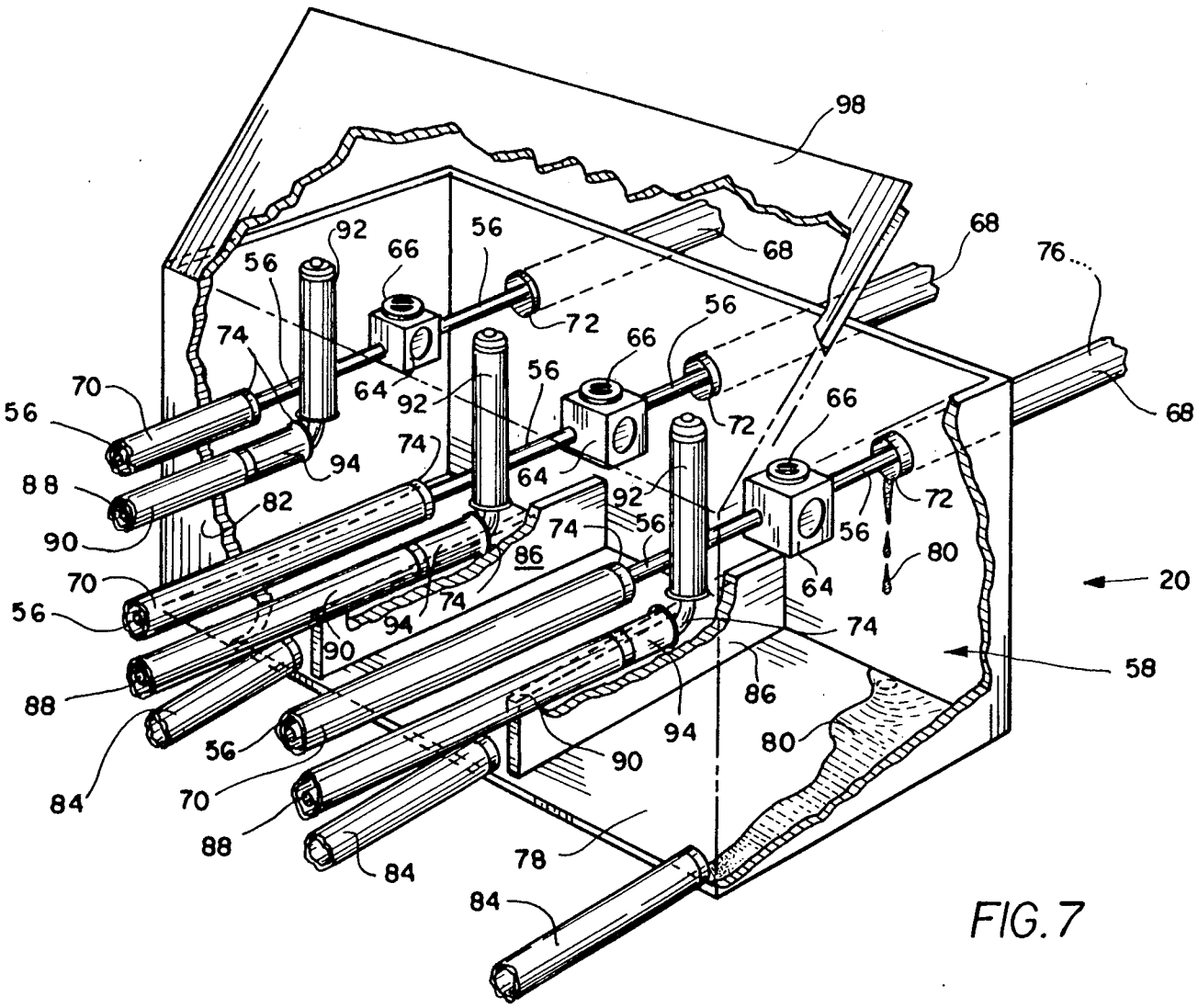
FIG. 7 is an enlarged top perspective view of the service chamber and plurality of pipelines communicating therewith.

The detection, collection and re-direction of a leakage occurring at any point within each delivery pipeline 56 is accomplished by enshrouding this pipeline with an outer conduit or casing, each comprising first and second sections 68, 70. The first casing section 68 extends from the delivery station union 60 to a signal end 72 disposed within the service chamber basin 58 while the second casing section 70 similarly communicates from the tank union 62 to a signal end 74 located within the same basin 58. An important feature of the conduit assembly 16 is that each casing section 68 and 70 is inclined downwardly, toward the intermediate service chamber 20, as shown most clearly in FIGS. 5 and 6. In this manner, should a leak occur, say at point 76 in the pipeline 56 within the first section casing 68, any leaked liquid will move by gravity to the signal end 72 of the casing and thence drop upon the basin floor 78. This floor, as also shown in FIG. 7, is generally level but above the tanks of the tank container assembly 12, and thus the leakage 80 will be seen to puddle and gradually move in the direction of the wall 82 of the service chamber 20. At the other end of this level floor 78, the liquid is carried off by a return drain line 84 which is inclined downwardly toward one of the storage tanks 24, 26, 28. As both sections 68 and 70 of the delivery pipeline are inclined downwardly toward the service chamber 20, it follows that a leak developing in either portion of this pipeline will gravitate and be detected in the single catch basin 58.

In the case of gasoline motor fuels, it would be permissible to collect the leakage from any one of the plurality of first section casings 68 and to allow it to drain back to that storage tank holding the lowest rated gasoline. On the other hand, when widely diverse fuel products, such as gasoline, kerosene and diesel oil are involved, any leakage from one pipeline must obviously be segregated at all times. In such instances, a partition wall or barrier 86 extending up from the basin floor 78 isolates the leakage as collected from each separate casing signal end 72 and thence directs it to an individual return drain line directed to one tank holding the same grade of fuel.

Other pipelines will be understood to be employed in the same overall system and these are also provided with the same leak recovery protocol as has been described above. A tank filler conduit assembly 14 is provided for each storage tank 24, 26, 28 and includes a filler pipeline 88 likewise surrounded by an outer conduit or casing 90 inclining downwardly toward the respective tank. A vertical filler pipe 92 projects upwardly from the first end 94 of the pipeline 88, within the service chamber 20 while the second end 96 is joined to a fitting entering the tank. With this construction, liquid may be supplied to a selected filler pipe 92 to stock the respective tank and if a fault exists in the pipeline 88, the leakage will drain by gravity within the casing 90 to its signal end 74 and thence be returned to the same tank being stocked, by way of the return drain line 84.

From the above, it will be seen that should a fault develop in either section of the delivery pipeline 56 or, in the filler pipeline 88, the leakage therefrom will gravitate to only the single spill basin 58 wherein the leakage will be readily detected any time the cover 98 is raised. As the filler pipe 92 is accessed within the spill basin 58, it follows that with each shipment of fuel, one's senses will be exposed to the interior of the service chamber 20. By simply scheduling additional periodic inspections of the spill basin 58, little time need expire between inspections and accordingly, should a leak develop, normally but a small amount of liquid will have leaked from the faulty pipeline before being discovered.

The above related construction lends itself to an improved process of accomplishing a repair of a leakage developing in any one of the pipelines 56 or 88 which are those lines subjected to either frequent or intermittent full flow fluid transmission. The visual detection of the leaking fuel 80 immediately identifies the associated pipeline section containing the faulty portion. Thereafter, without any excavation or lengthy down-time, the suspect pipeline section is readily removed by disconnecting its opposite ends where called for. In the case of either section of the delivery pipeline 56, its opposite ends are uncoupled from the union 64 and either union 60 or 62. Thereafter, by grasping its end within the basin 58 and pulling upwardly and away from the service chamber 20, as shown in FIG. 5, the suspect pipeline section is fully removed and immediately replaced with a serviceable pipeline of similar length. When thusly installed, its opposite ends are coupled to the existing unions and full service is immediately restored. Both sections of the delivery pipeline 56 may be removed and installed by manipulating them through the opened service chamber 20 while the second section leading to the tanks may alternatively be replaced through the opened tank vault 32, as shown in FIG. 6.

It will be understood that the inherent construction of conduits as approved for fuel transmission in this environment, permits of sufficient flexibility to achieve the above described flexing of the pipelines during this manipulation. In this respect, although the material of the pipeline 56 is shown in FIG. 3 to comprise metal and that of the casing to comprise a synthetic resin, either conduit may be formed of either material as appropriate.

As soon to be enforced Federal requirements call for a periodic removal, testing and re-treatment of all fuel storage tanks, the instant system provides a most economical manner of accomplishing this task with but a minimum of down-time and expense. Although each tank vault cover 46 includes an access manhole 48 and manhole cover 100 overlying the pipeline fittings therebeneath, the entire, relative lightweight covers 46 may be easily lifted off to expose the top opening 40 of the entire vault 32 and this may be facilitated by the inclusion of retractable handles 102 in the covers. Thereafter, the backfill material 44 is readily removed to fully expose the tanks and after disconnecting any pipe fittings encountered, by mechanically engaging appropriate lift fittings 104 on each tank, it is quickly hoisted for the required servicing.

It is to be understood that the present invention is not limited to the sole embodiment described above, but encompasses any and all embodiments within the scope of the following claims.

I claim:

1. A liquid storage and delivery apparatus comprising:

a liquid storage tank, a liquid dispensing station remote to said tank, a delivery pipeline including an intermediate portion and having opposite ends respectively communicating with said tank and dispensing station for directing liquid from said tank to said dispensing station, a service chamber containing said pipeline intermediate portion and forming a spill basin having a floor disposed beneath said pipeline intermediate portion, and an access door on said service chamber, a casing enshrouding said delivery pipeline from at least one said opposite end and extending to provide a signal end terminating within said service chamber, said conduit inclined downwardly toward said service chamber, whereby leakage of liquid developing within said delivery pipeline enshrouded by said casing results in this liquid leakage being directed by gravity to said casing signal end and thence being deposited upon said spill basin floor, a drain pipeline having opposite ends respectively communicating with said service chamber immediately adjacent to said basin floor and said storage tank, and said drain pipeline inclined downwardly from said service chamber to said storage tank, whereby liquid leakage as deposited upon said spill basin floor is automatically thence directed to said storage tank for recycling to said dispensing station.

2. The liquid storage and delivery apparatus of claim 1, including coupling means joined to said delivery pipeline opposite ends.

3. The liquid storage and delivery apparatus of claim 1, wherein said service chamber is substantially rectangular and includes a level floor having a lowermost portion, and said drain pipeline juxtaposed said lowermost floor portion.

4. The liquid and storage delivery apparatus in claim 1, including an open top vault disposed within the ground, said tank fully contained within said vault, lift means on said tank, aggregate material surrounding said tank within said vault, and removable cover means enclosing said vault open top.

5. The liquid storage and delivery apparatus of claim 2, including valve means adjacent at least one said coupling means.

6. The liquid storage and delivery apparatus of claim 1, including a filler pipeline enshrouded by a casing and having opposite ends respectively communicating with said service chamber and said tank, and said filler pipeline casing inclined downwardly toward said service chamber.

* * * * *